US006397947B1

(12) United States Patent
Behrmann et al.

(10) Patent No.: US 6,397,947 B1
(45) Date of Patent: Jun. 4, 2002

(54) OPTIMIZING CHARGE PHASING OF A PERFORATING GUN

(75) Inventors: Lawrence A. Behrmann, Houston; Jorge E. Lopez de Cardenas, Sugar Land; Robert A. Parrott, Houston, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/564,840

(22) Filed: May 4, 2000

Related U.S. Application Data

(60) Provisional application No. 60/132,441, filed on May 4, 1999, and provisional application No. 60/132,619, filed on May 5, 1999.

(51) Int. Cl.[7] ..... E21B 43/117

(52) U.S. Cl. ..... 166/297; 166/55.1; 175/4.6; 102/310

(58) Field of Search ..... 166/297, 55.1; 175/4.6; 102/310, 320

(56) References Cited

U.S. PATENT DOCUMENTS

| | | | | |
|---|---|---|---|---|
| 4,726,431 A | | 2/1988 | Oestreich et al. | |
| 4,844,170 A | | 7/1989 | Gill | |
| 4,960,171 A | | 10/1990 | Parrott et al. | |
| 5,054,564 A | | 10/1991 | Oestreich et al. | |
| 5,211,714 A | * | 5/1993 | Jordan et al. | 166/297 |
| 5,392,857 A | | 2/1995 | Behrmann | |

* cited by examiner

*Primary Examiner*—William Neuder
(74) *Attorney, Agent, or Firm*—Trop, Pruner & Hu P.C.

(57) ABSTRACT

A method includes arranging shaped charges in a perforating gun to produce perforation holes in a helical pattern that is defined in part by a phase angle; and choosing four adjacent perforation holes to be created that are adjacent nearest neighbors. The distances are determined between three of the four adjacent perforation holes to be created. A standard deviation is minimized between the three adjacent perforation holes. The phase angle is set based on the minimization.

33 Claims, 9 Drawing Sheets

OPTIMIZING CHARGE PHASING OF A PERFORATING GUN

This application claims the benefit, pursuant to 35 U.S.C. § 119, to U.S. Provisional Application Ser. No. 60/132,441, entitled, "OPTIMIZING CHARGE PHASING OF A PERFORATING GUN," filed on May 4, 1999, and U.S. Provisional Application Ser. No. 60/132,619, entitled, "OPTIMIZING CHARGE PHASING OF A PERFORATING GUN," filed on May 5, 1999.

BACKGROUND

The invention generally relates to optimizing charge phasing of a perforating gun.

For purposes of enhancing production from a subterranean formation, a perforating gun typically is lowered down into a wellbore (that extends through the formation), and radially oriented shaped charges (of the perforating gun) are detonated to form perforations in the formation. Typically, specified parameters called a shot density and a phasing (described below) control the number of shaped charges of the gun and the distances between the shaped charges. If the spacing between two adjacent perforations near the sandface is too small, then a portion of the formation (called a bridge) that is located between the adjacent perforations may fail and permit communication between the perforations. This bridge failure may cause disaggregated sand to be produced through the perforations.

As an example, referring to FIG. 1, a perforating gun 20 includes shaped charges 10 (shaped charges 10*a*, 10*b* and 10*c*, as examples) that extend around a central axis of the gun 20 in a helical, or spiral, pattern. Each shaped charge 10 points radially outwardly toward a well casing 12, and adjacent shaped charges 10 in the spiral pattern are radially separated by a phase angle of 135° (as an example), i.e., the phasing of the shaped charges 10 is 135°.

SUMMARY

In one embodiment, a method includes arranging shaped charges in a perforating gun to produce perforation holes in a helical pattern that is defined in part by a phase angle; and choosing four adjacent perforation holes to be created that are adjacent nearest neighbors. The distances are determined between three of the four adjacent perforation holes to be created. A standard deviation is minimized between the three adjacent perforation holes. The phase angle is set based on the minimization.

Other embodiments and features will become apparent from the following description, from the drawings, and from the claims.

DETAILED DESCRIPTION

Figure 1:
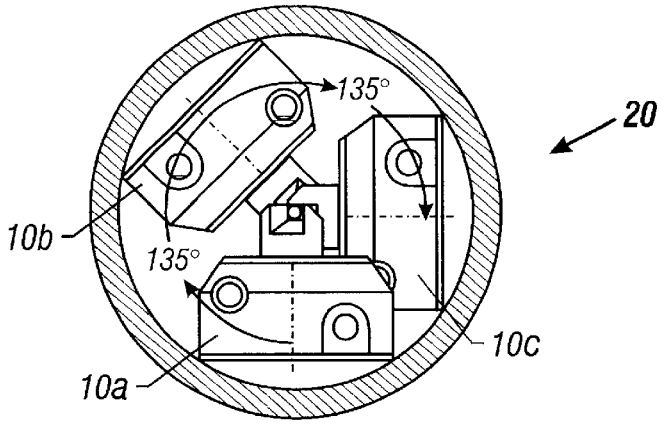
FIG. 1 (Prior Art)
FIG. 1 is a cross-sectional view of a perforating gun.
Figure 2:
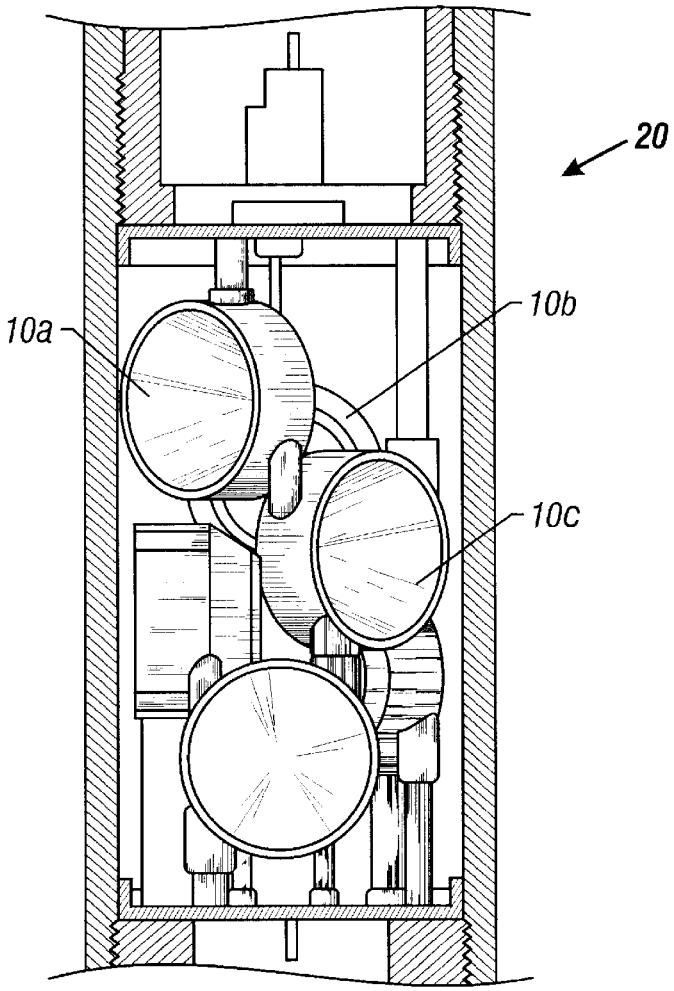
FIG. 2 (Prior Art)
FIG. 2 is a schematic side view of a perforating gun of the prior art.
Figure 3:
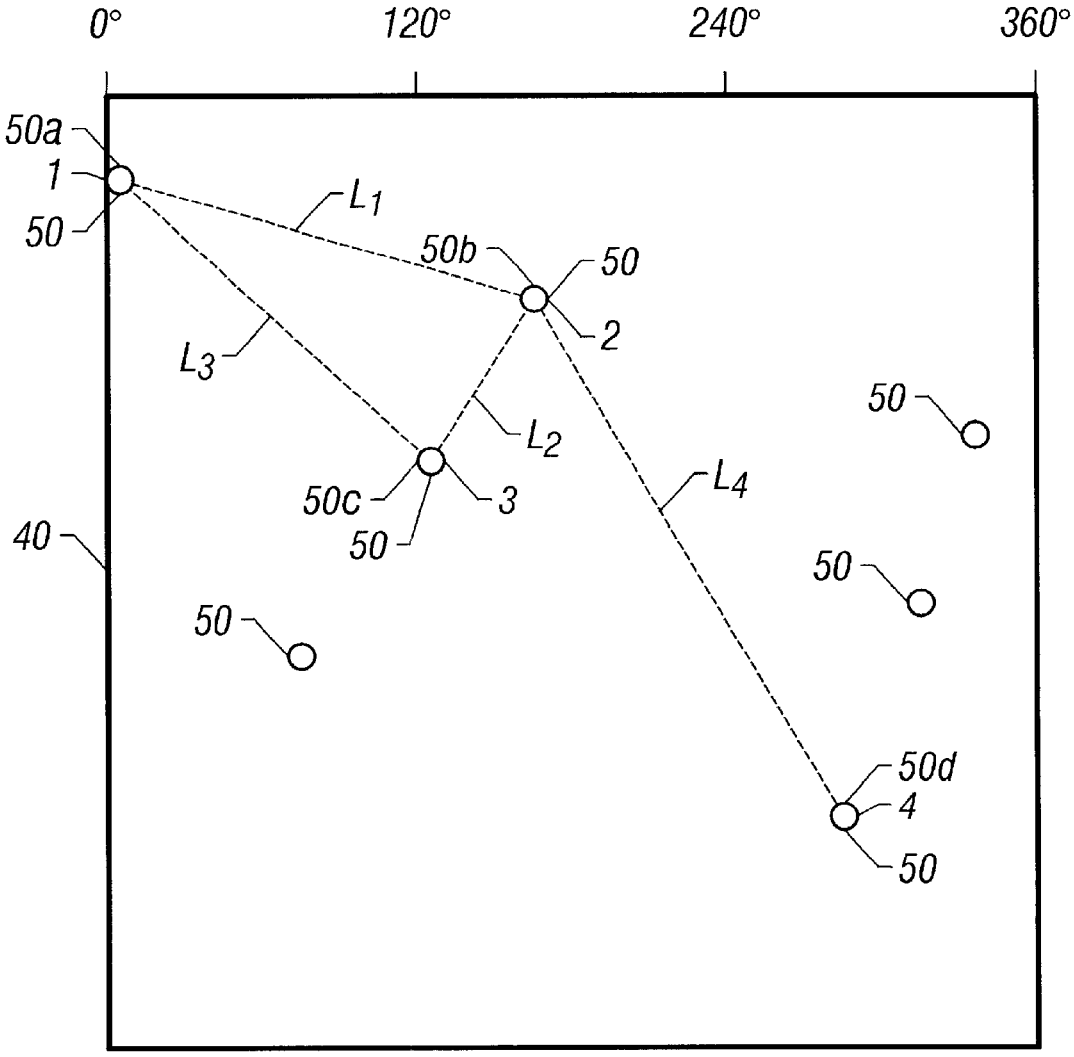
FIGS. 3 and 4 are schematic diagrams illustrating a pattern of perforation holes in the sandface according to an embodiment of the invention.
Figure 4:
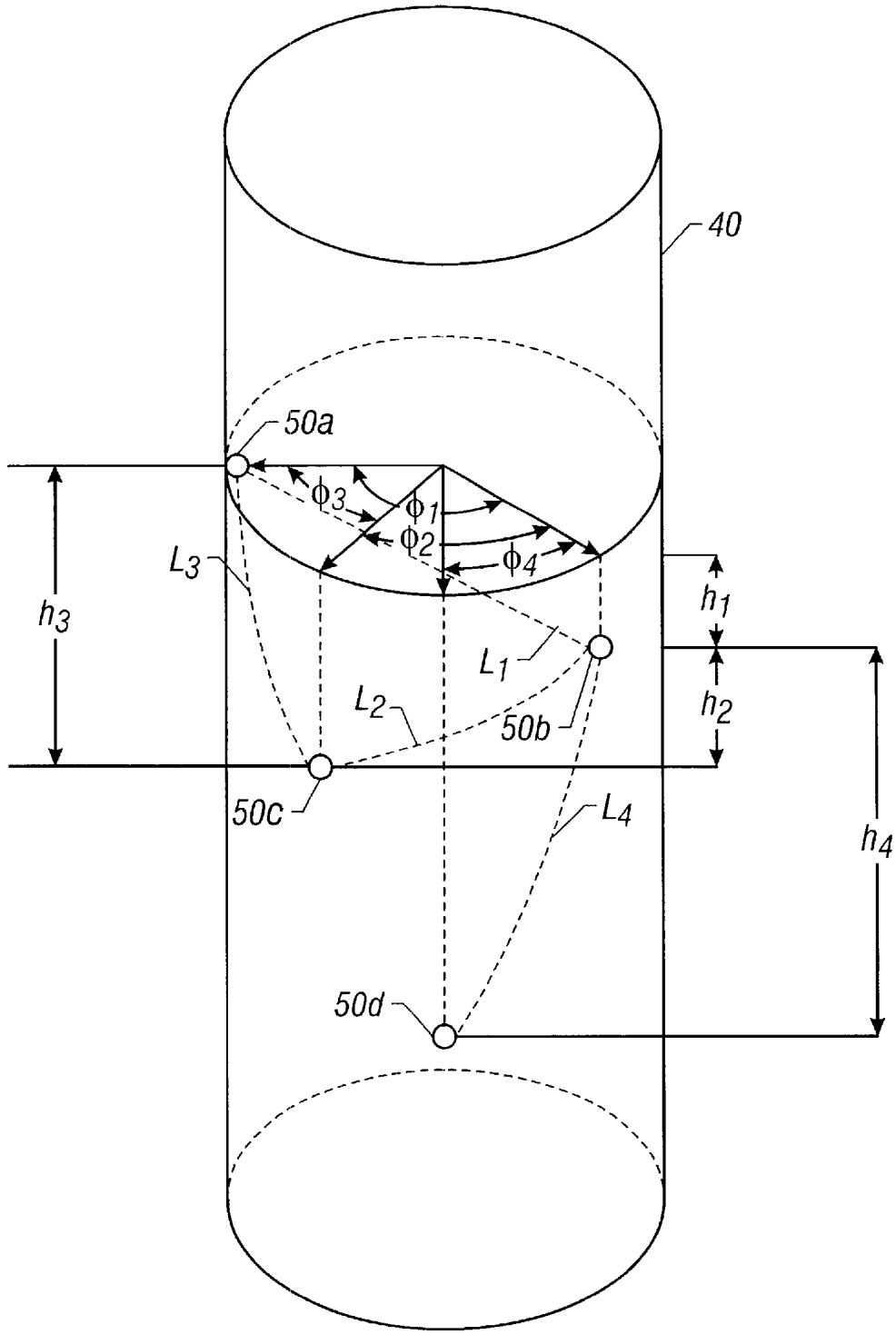

Referring to FIGS. 3 and 4, an embodiment of a perforating gun in accordance with the invention has shaped charges that are arranged in a helical, or spiral, pattern to produce perforations in a sandface 40. In particular, in some embodiments, the shaped charges are arranged to produce a corresponding spiral pattern of perforation holes 50 (perforation holes 50*a*, 50*b*, 50*c* and 50*d*, as examples) in the sandface 40. In this manner, the spiral pattern may include wrap around the sandface 40 several times, i.e., include several windings. For the exemplary pattern depicted in FIG. 3, the pattern wraps around the sandface 40 three times. It has been discovered, for the case where the spiral pattern includes approximately three or more windings around the sandface 40, four distances $L_1$, $L_2$, $L_3$ and $L_4$ between adjacent shaped charges (as indicated by the corresponding perforation holes 50) need to be considered to maximize the distances between adjacent perforations in a formation. More particularly, the phasing of the corresponding shaped charges may be optimized by phasing the shaped charges at an optimal phase angle that causes two of the $L_1$, $L_2$, $L_3$ and $L_4$ distances to be approximately equal to each other.

For example, a perforation hole 50*b* of a first winding may be selected. For this selection, the following distances are used to determine the optimal phase angle: the distance L, between the perforation hole 50*b* and another perforation hole 50*a* of the first winding; the distance $L_2$ between the perforation hole 50*b* and another perforation hole 50*c* of the second winding; the distance $L_3$ between the perforation holes 50*a* and 50*c*; and the distance $L_4$ between the perforation hole 50*b* and a perforation hole 50*d* of the third winding. In particular the $L_1$, $L_2$, $L_3$ and $L_4$ distances may be described by the following equations:

$$L_1=\sqrt{(r\phi)^2+h_1^2}$$

$$L_2=\sqrt{(r\phi_2)^2+h_2^2}$$

$$L_3=\sqrt{(r\phi_3)^2+h_3^2}$$

$$L_4=\sqrt{(r\phi_4)^2+h_4^2}$$

where "r" represents the distance to the sandface 40 (for a sand prevention completion) as measured from the center of the perforating gun; "$\phi_1$" represents the radial angle (about the axis of the sandface 40) between the perforation holes 50*a* and 50*b*; "$\phi_2$" represents the radial angle between the perforation holes 50*b* and 50*c*; "$\phi_3$" represents the radial angle between the perforation holes 50*a* and 50*c*; "$\phi_4$" represents the radial angle between the perforation holes 50*b* and 50*d*; "$h_1$" represents a distance by which the perforation holes 50*a* and 50*b* are separated along the well axis; "$h_2$" represents a distance by which the perforation holes 50*b* and 50*c* are separated along the well axis; "$h_3$" (the sum of h, and $h_2$) represents a distance by which the perforation holes 50*a* and 50*c* are separated along the well axis; and "$h_4$" represents an axial distance between perforation holes 50*b* and 50*d*.

From these equations, different values for $\phi_1$ may be substituted until an optimal phase angle is found, a condition that is indicated by two of the $L_1$, $L_2$, $L_3$ and $L_4$ distances being equal. The distance $L_4$ is only significant when the product of the shot density and the distance r exceeds a predetermined threshold. In some embodiments, when the shot density is expressed in shots/foot and the distance r is expressed in inches, the predetermined threshold may be approximately 42.

In other embodiments, the value chosen for distance r in the equations above may be based on the type of completion. For example, referring to FIG. 8, for a natural completion in a strong sandstone or carbonate formation (as examples) failure of the bridges between the perforations may be highly unlikely, and as a result, efficiently draining the reservoir may be a greater concern. For this case, the distance r may be chosen to maximize production from the formation. More particularly, in some embodiments, the distance r may extend from the center of a perforating gun 170 to a point of a particular perforation 182 near where the highest flow rates of production occur. In this manner, the flow rate of production fluid into the perforation 182 typically is the largest near the far end of the perforation 182, an end that is located a distance D from the center of the perforating gun 170. The flow rates substantially decrease closer to a sandface 180, at a distance of approximately ½-D to ¾-D from the center of the perforating gun 170. Therefore, in some embodiments, to maximum the production, the distance r may extend beyond the sandface 180. In this manner, the distance r may be assigned a value in approximately in the range of ½-D to ¾-D. The optimal phase angle may then be computed as described above using this radius.

Figure 9:
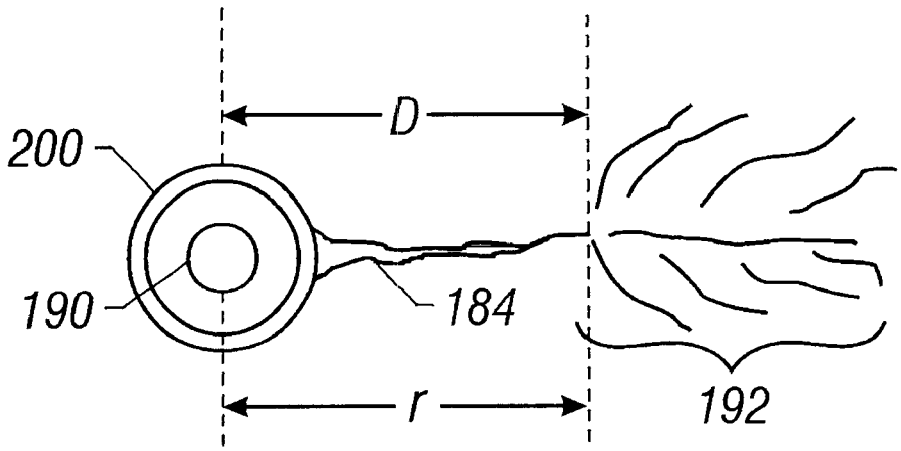

Referring to FIG. 9, as another example, the formation being perforated may be a carbonate formation, a formation into which acids may be introduced via perforations 184 (only one such perforation 184 being depicted in FIG. 9). In this manner, the acid may form tunnels 192, beginning near the end of the perforation 184. For this type of production environment, the largest flow rates occur near the tunnels 192. Therefore, to maximize production, instead of choosing the distance r to extend to a sandface 200, the distance r is alternatively chosen to extend to the end of the perforation 184 and have a value approximately equal to the distance D from the center of the perforating gun 190 to the end of the perforation 184. The optimal phase angle may then be computed as described above using this radius.

Figure 8:
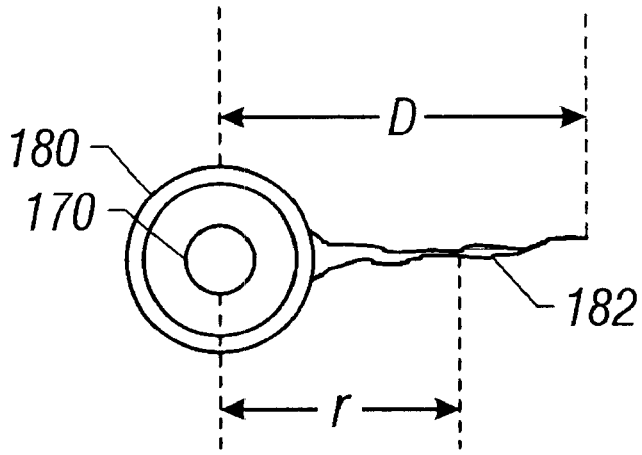
FIGS. 8 and 9 are cross-sectional views of wells illustrating different perforating radii for different types of wells.

Other values for the distance r that cause the distance r to extend beyond the sandface may be chosen based on the type of completion and/or formation. The perforating gun 170, 190 in the cross-sections depicted in FIGS. 8 and 9 is concentric with respect to the sandface. However the distance r may be adjusted for the eccentric arrangements, as described above.

Figure 14:
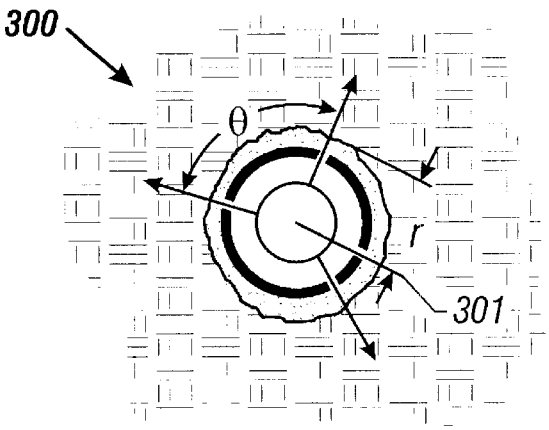
FIGS. 14, 15 and 16 depict different completion types illustrating different definitions for the distance shown in FIG. 13.
Figure 15:
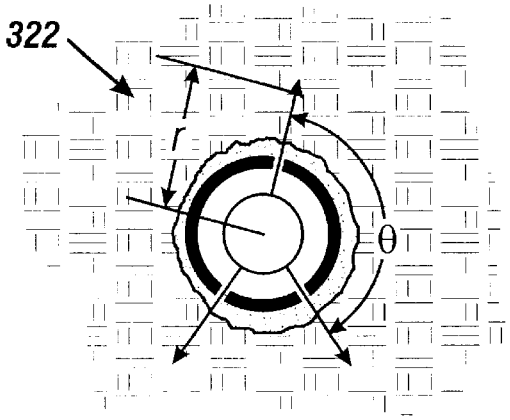
Figure 16:
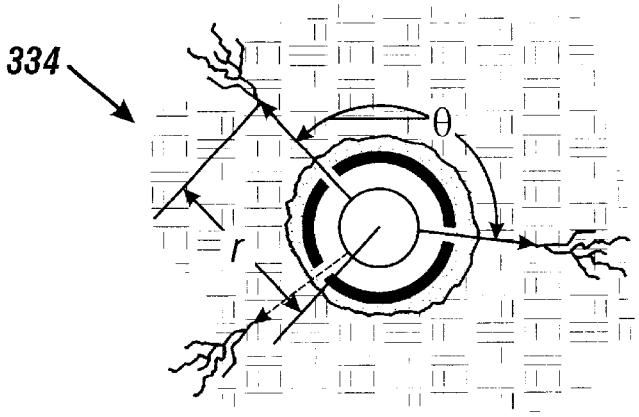

The distance r is chosen to optimize some characteristic of the well. For example, FIG. 14 depicts a distance r chosen in a well 300 to establish optimum phasing at a sand interface 301. FIG. 15 depicts a distance r chosen in a well 322 to establish optimum phasing to maximize production at a predefined distance into the formation. FIG. 16 depicts a distance r chosen in a well 334 to optimize phasing where acidization occurs.

Figure 13:
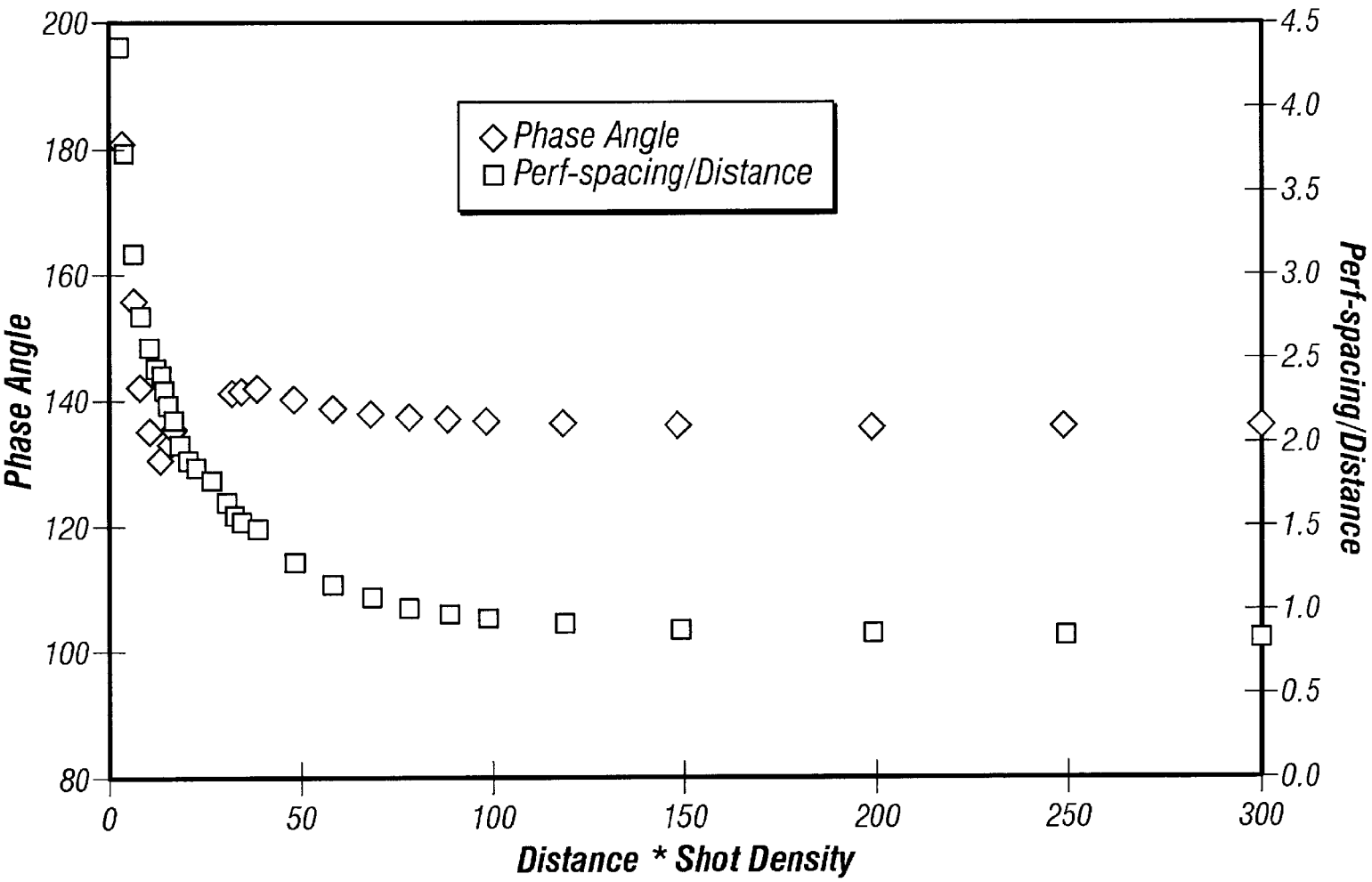
FIG. 13 is a plot of an optimum phase angle and a minimum perforation hole-to-perforation hole distance versus the product of shot density and distance.

FIG. 13 depicts an optimum perforation phasing for maximum perforation hole-to-perforation hole spacing. As shown, as the product of the perforation distance and the shot density increases, the optimum phase angle approaches an angle near approximately 140°.

Figure 5:
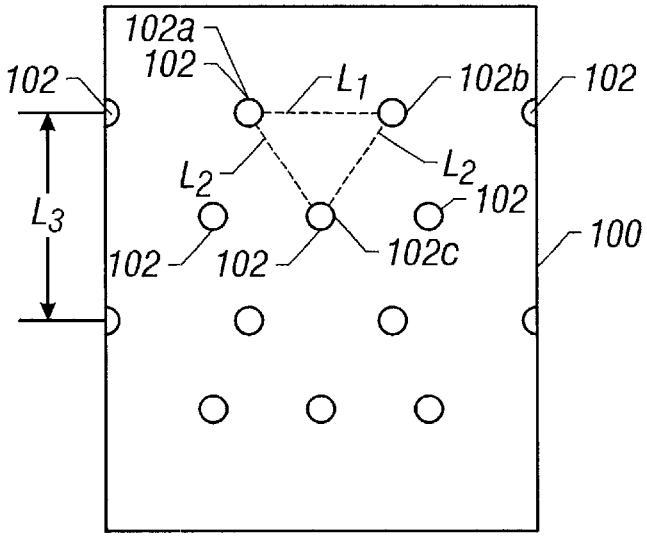
FIGS. 5, 10, 11 and 12 are schematic diagrams illustrating patterns of perforation holes according to different embodiments of the invention.

Optimal phase solutions may also be found for a perforating gun that has shaped charges that are arranged in planes. In this manner, referring to FIG. 5, this type of perforating gun includes shaped charges that are arranged to produce perforation holes 102 (perforation holes 102*a*, 102*b* and 102*c*, as examples) in a sandface 100. The perforation holes 102 (and the corresponding shaped charges) are arranged in alternating planes, and the normal of each plane is parallel to the well axis. The perforation holes 102 (and corresponding shaped charges) of each plane are located between the perforation holes (and corresponding shaped charges) of an adjacent plane. In some embodiments, each perforation hole 102 (the perforation hole 102*c*, for example) is located a distance $L_2$ from the two closest perforation holes (perforation holes 102*a* and 102*b*, as examples) and located a distance (called $L_1$) from the adjacent perforation holes 120 (perforation hole 102*b*, for example) of the same plane.

The equations to determine $L_1$, $L_2$ and $L_3$ are described below:

$$L_1=2\pi r/i$$

$$L_2=1/2\sqrt{L_1^2+L_3^2}$$

$$L_3=2(12)i/N,$$

where "N" represents the number of shots per foot and "i" represents the number of shots per plane.

Figure 6:
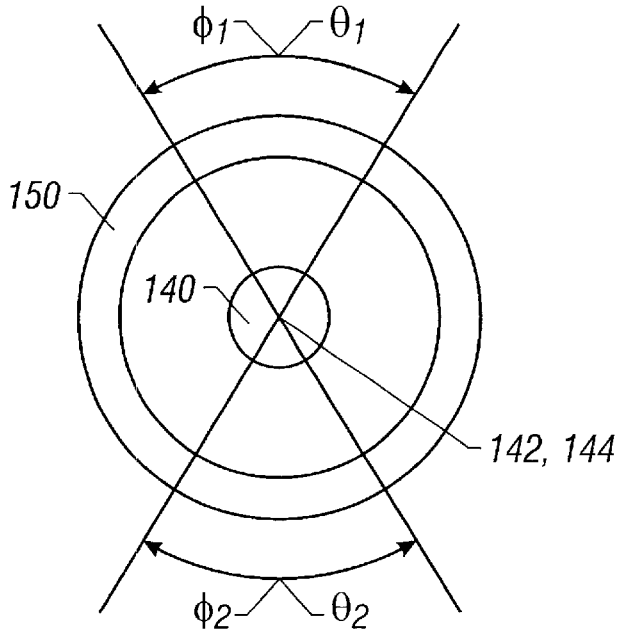
FIGS. 6 and 7 are cross-sectional views of a well illustrating the design of different perforating guns according to different embodiments of the invention.

Referring to FIG. 6, in some embodiments, a perforating gun 140 may include shaped charges that are arranged to produce perforations in the sandface 150 with a specified orientation. In this manner, the shaped charges may be arranged to perforate a top portion of the sandface 150 over an angle $\phi_1$ and arranged to perforate a bottom portion of the well casing 150 over an angle $\phi_2$ As depicted in FIG. 6, in some embodiments, the $\phi_1$ and $\phi_2$ angles are approximately equal to each other, and the perforating gun 140 is concentric with the sandface 150 (i.e., a center 142 of the sandface 150 is aligned with a center 144 of the perforating gun 140). However, in other embodiments, the perforating gun 140 may be eccentric to the sandface 150 (a scenario described below) and/or the $\phi_1$ and $\phi_2$ angles may be different.

Figure 10:
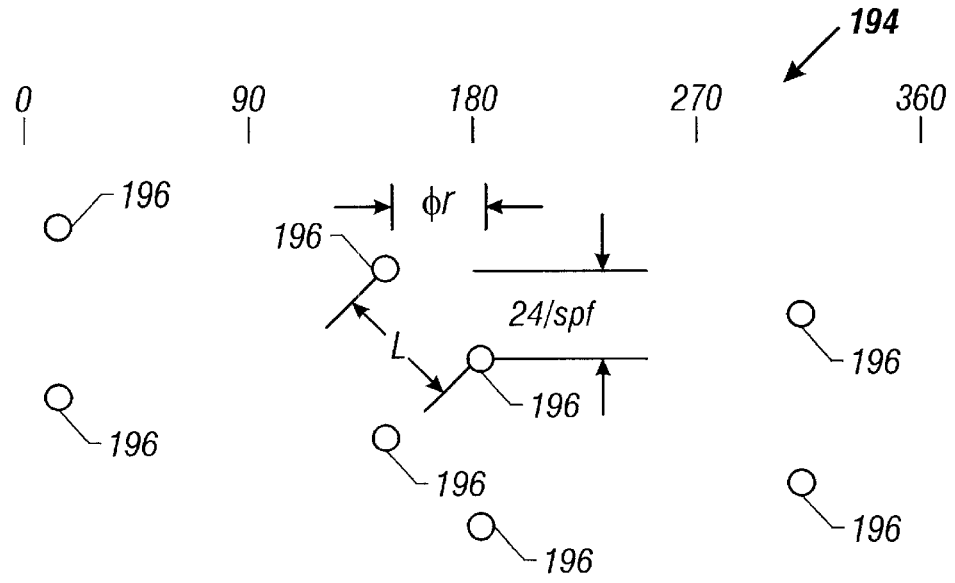

To determine the shot density for the lateral well, the perforation-to-perforation spacing needs to be taken into account for purposes of preventing perforation failures. Thus, this design consideration tends to decrease the shot density. However, another design consideration is the optimization of the production flow, a consideration that tends to increase the shot density. Referring to FIG. 10 that depicts a perforation pattern 194, to take into account these considerations, the following equation describes the maximum shot density for a perforating gun in which the shaped charges are arranged in a spiral pattern:

$$\left(\frac{24}{spf}\right)^2 = L^2 - [\varphi r]^2,$$

where "spf" is the shot density, "L" is the minimum spacing between perforations 196, "$\phi$" is the angle of perforation, "r" is the radius of the wellbore for a centralized gun or the distance from the center of the gun to the sandface for a gun whose longitudinal axis is eccentric with respect to the axis of the wellbore and where $L>\phi r$. As an example for equal to 4.25 inches (in.), $\phi$ equal to 45 degrees and L equal to 4 inches, the maximum shot density is approximately equal to 10.89. This shot density is to be contrasted to a perforating gun that has shaped charges located at zero and one hundred eighty degrees, an arrangement that produces a maximum shot density of 6.

Figure 11:
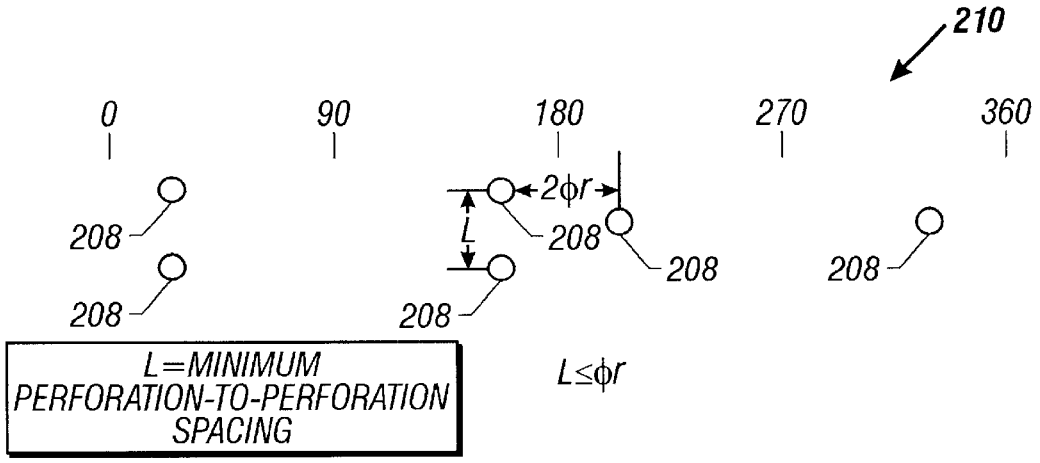

As another example, FIG. 11 depicts a pattern 210 of perforation holes 208 for a perforating gun that is used in larger wellbores and has shaped charges that are arranged in a planar fashion with two charges per plane. For this case, the axial distance (L) between adjacent aligned perforation holes 208 is less than or equal to $\phi r$. For this arrangement, the maximum shot density may be described by the following equation:

$$spf = \frac{48}{L},$$

where "L/2" is the distance between adjacent shaped charge planes.

Figure 12:
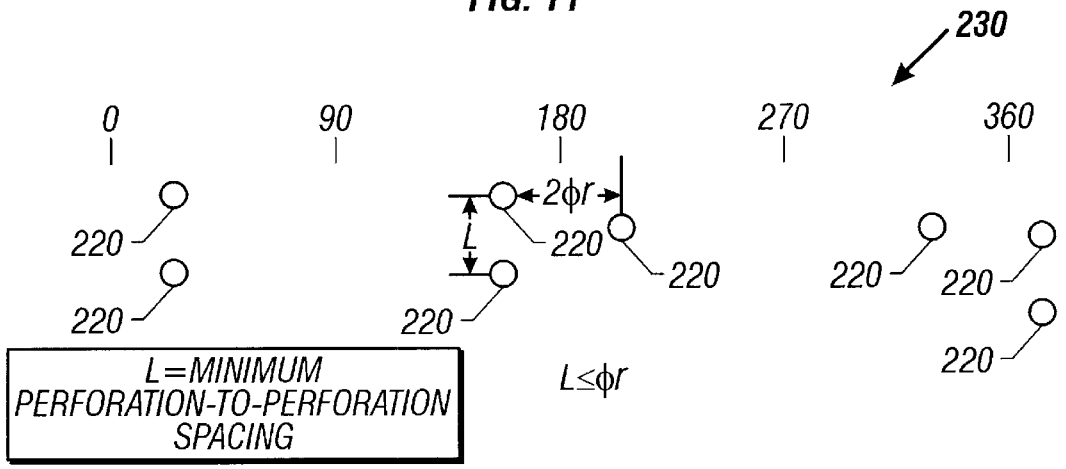

Referring to FIG. 12 that depicts a spiral perforation pattern 230, the axial distance (called L below) between adjacent aligned perforation holes 220 in different planes may also have to be considered in the spiral phasing pattern 230 if $L \leqq \phi r$, a case that is depicted in FIG. 12. In this case, "L/4" is the distance between each plane of perforation holes 220.

The perforating gun may be eccentric with respect to the sandface. For example, referring to FIG. 7, a perforating gun 146 may be positioned in a casing 160 so that the perforating gun 146 rests on the bottom portion of the casing 160 and is eccentric with respect to the sandface 150. Furthermore, it may be desired that the perforating gun 140 perforates a top portion 156 of the sandface 150. Conventional perforating guns may assume that the perforating gun is concentric with the sandface 150. However, this assumption may produce a perforation distribution that is larger than expected.

In contrast to conventional designs, the perforating gun 146 accounts for the eccentricity of the perforating gun 146 with respect to the sandface 150. In this manner, the shaped charges of the perforating gun 146 are arranged to produce a top perforation distribution angle (called $\theta_1$ and measured from the center 144 of the perforating gun 146 to the top portion 156) that is smaller than the $\phi_1$ angle in order to perforate just the desired top portion 156. Similarly, other shaped charges of the perforating gun 146 may be arranged to perforate a bottom portion 158 of the sandface 150. In particular, the perforating gun 146 is closer to the bottom portion 158 than if the perforating gun 146 were at the center 142 of the well casing 150. As a result, a bottom perforation distribution angle (called $\theta_2$ and measured from the center 140 of the perforating gun 140 to the bottom portion 156) is larger than a $\phi_2$ angle that is formed between the well center 142 and the bottom portion 156.

Figure 7:
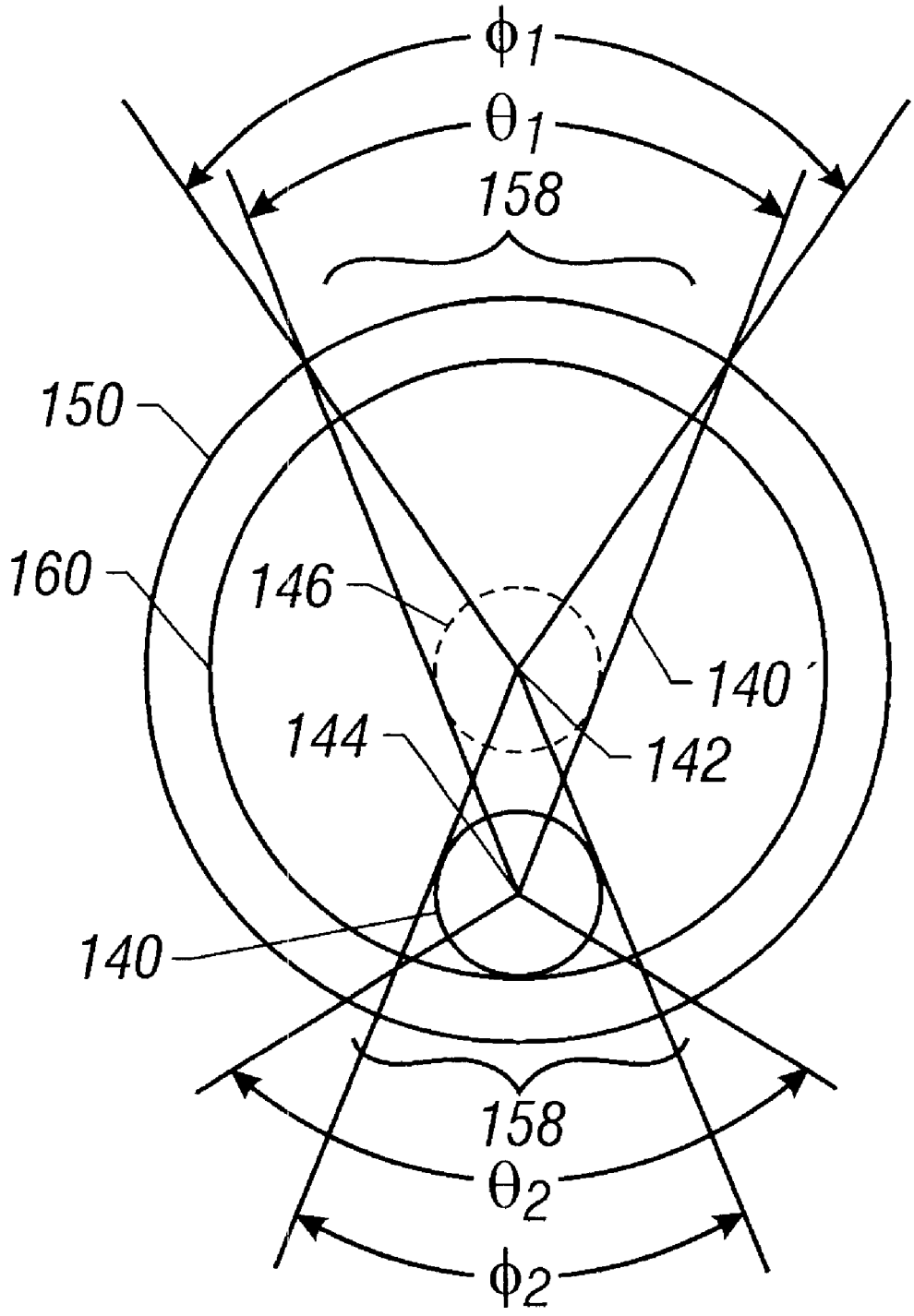

Other embodiments are possible. For example, as depicted in FIG. 7, the $\phi_2$ angle is less than the $\phi_1$ angle. However, in other embodiments, the $\phi_2$ angle may be greater than the $\phi_1$ angle. In some embodiments, the $\phi_2$ and $\phi_1$ angles may be different, and the perforating gun 146 may be concentric with respect to the sandface 150.

While the invention has been disclosed with respect to a limited number of embodiments, those skilled in the art, having the benefit of this disclosure, will appreciate numerous modifications and variations therefrom.

What is claimed is:

1. A method comprising:

a. arranging shaped charges in a perforating gun to produce perforation holes in a helical pattern that is defined in part by a phase angle, the helical pattern including first, second and third windings;

b. determining a first distance between a first one of the perforation holes of the first winding and a second one of the perforation holes of the first winding;

c. determining a second distance between said first one of the perforation holes and a third one of the perforation holes of the second winding;

d. determining a third distance between the second and third perforation holes;

e. determining a fourth distance between the first perforation hole and a fourth one of the perforation holes of the third winding;

f. changing the phase angle and repeating acts b, c, d and e as required until two of the first, second, third and fourth distances are approximately equal; and g. phasing the shaped charges using approximately the phase angle that causes said two of the first, second, third and fourth distances to be approximately equal.

2. The method of claim 1, wherein the act of phasing the shaped charges comprises:

orienting the shaped charges to establish the perforation holes at a predefined radius from a longitudinal axis of the perforating gun to optimize production performance near a sand interface of a well.

3. The method of claim 1, wherein the act of phasing the shaped charges comprises:

orienting the shaped charges to establish the perforation holes at a predefined radius from a longitudinal axis of the perforating gun to optimize production of well fluid.

4. The method of claim 1, wherein the act of phasing the shaped charges comprises:

orienting the shaped charges to establish the perforation holes at a predefined radius from a longitudinal axis of the perforating gun to optimize acidization of a well.

5. The method of claim 1, further comprising: phasing the shaped charges to account for an eccentricity of the perforating gun with respect to a well bore.

6. The method of claim 1, wherein the act of changing the phase angle and repeating acts b, c, d and e includes considering all of the first, second, third and fourth distances.

7. A method comprising:

arranging shaped charges in a perforating gun to produce perforation holes in a helical pattern that is defined in part by a phase angle;

choosing four adjacent perforation holes to be created that are adjacent nearest neighbors;

determining distances between three of said four adjacent perforation holes to be created;

minimizing a standard deviation between said three of said four adjacent perforation holes to be created; and setting the phase angle based on the minimization.

8. The method of claim 7, wherein the setting the phase angle comprises:

orienting the shaped charges to establish the perforation holes at a predefined radius from a longitudinal axis of the perforating gun to optimize production performance near a sand interface of a well.

9. The method of claim 7, wherein the setting the phase angle comprises:

orienting the shaped charges to establish the perforation holes at a predefined radius from a longitudinal axis of the perforating gun to optimize production of well fluid.

10. The method of claim 7, wherein the setting the phase angle comprises:

orienting the shaped charges to establish the perforation holes at a predefined radius from a longitudinal axis of the perforating gun to optimize acidization of a well.

11. The method of claim 7, further comprising:

phasing the shaped charges to account for an eccentricity of the perforating gun with respect to a well bore.

12. A perforating gun comprising:

shaped charges arranged in a helical pattern pursuant to a phasing pattern to produce perforation holes, a phase angle of the phasing pattern minimizing a standard deviation of three shortest distances of four distances taken between four adjacent nearest neighbors of the perforation holes.

13. The perforating gun of claim 12, wherein the shaped charges are oriented to establish the perforation holes at a predefined radius to optimize performance at a sand interface of a well.

14. The perforating gun of claim 12, wherein the shaped charges are oriented to establish the perforation holes at a predefined radius to optimize production of well fluid.

15. The perforating gun of claim 12, wherein the shaped charges are oriented to establishing the perforation holes at a predefined radius to optimize acidization of a well.

16. The perforating gun of claim 12, wherein the phase angle accounts for an eccentricity of the perforating gun with respect to a well bore.

17. A perforating gun for use in a lateral wellbore in which the perforating gun is eccentric with respect to an axis of the wellbore, comprising:

a first group of shaped charges to perforate an upper sandface of the wellbore over a first angle; and a second group of shaped charges to perforate a lower sandface of the wellbore over a second angle.

18. The perforating gun of claim 17, wherein the first angle is substantially different from the second angle.

19. The perforating gun of claim 17, wherein the first angle is approximately the same as the second angle.

20. The perforating gun of claim 17, wherein the charges are oriented to maximize a minimum perforation-to-perforation spacing at the sandface and maximize a shot density.

21. A method comprising:

arranging shaped charges of a perforating gun to perforate over a predefined angle based in part on a radial distance from a center of the perforating gun to a point; and selecting the point to extend the radial distance beyond a sandface based on a type of formation to be perforated.

22. The method of claim 21, wherein the act of selecting comprises:

choosing the point to set the radial distance to approximately one half to three fourth of a distance from the center of the perforating gun to an end of a perforation when the formation substantially comprises sandstone formation.

23. The method of claim 21, wherein the act of selecting comprises:

choosing the point to set the radial distance to approximately a distance from the center of the perforating gun to an end of a perforation when the formation substantially comprises a carbonate formation.

24. A method comprising:

a. arranging shaped charges in a perforating gun to produce perforation holes arranged in at least a first plane, a second plane and a third plane, each of the first, second and third planes having a normal substantially aligned with a longitudinal axis of the perforating gun;

b. determining a first distance between a first one of the perforation holes of the first plane and second one of the perforation holes of the second plane;

c. determining a second distance between said second one of the perforation holes and a third one of the perforation holes of the second plane;

d. determining a third distance between the first and third planes;

f. changing the phase angle and repeating acts b, c and d as required to maximize the distances between the perforation holes until two of the first, second and third distances are approximately equal; and g. phasing the shaped charges using approximately the phase angle that causes said two of the first, second and third distances to be approximately equal.

25. The method of claim 24, wherein the act of phasing the shaped charges comprises:

orienting the shaped charges to establish the perforation holes at a predefined radius from a longitudinal axis of the perforating gun to optimize production performance near a sand interface of a well.

26. The method of claim 24, wherein the act of phasing the shaped charges comprises:

orienting the shaped charges to establish the perforation holes at a predefined radius from a longitudinal axis of the perforating gun to optimize production of well fluid.

27. The method of claim 24, wherein the act of phasing the shaped charges comprises:

orienting the shaped charges to establish the perforation holes at a predefined radius from a longitudinal axis of the perforating gun to optimize acidization of a well.

28. The method of claim 24, further comprising:

phasing the shaped charges to account for an eccentricity of the perforating gun with respect to a well bore.

29. A method comprising:

arranging perforating charges to form a perforating gun; and phasing the perforating charges to take into account an eccentricity between a longitudinal axis of the perforating gun and a wellbore axis that extends through a formation to be perforated.

30. The method of claim 24, wherein the act of changing the phase angle and repeating acts b, c, d and e includes considering all of the first, second, third and fourth distances.

31. The method of claim 29, wherein the act of phasing the shaped charges comprises:

orienting the shaped charges to establish the perforation holes at a predefined radius from the longitudinal axis of the perforating gun to optimize production performance near a sand interface of a well.

32. The method of claim 29, wherein the act of phasing the shaped charges comprises:

orienting the shaped charges to establish the perforation holes at a predefined radius from a longitudinal axis of the perforating gun to optimize production of well fluid.

33. The method of claim 31, wherein the phasing the shaped charges comprises:

orienting the shaped charges to establish the perforation holes at a predefined radius from a longitudinal axis of the perforating gun to optimize acidization of a well.

* * * * *